United States Patent [19]

Zlotek

[11] Patent Number: 4,852,750

[45] Date of Patent: Aug. 1, 1989

[54] ELEMENT FOR DRESSING SHELVES AND DISPLAY COMPOSED OF SUCH ELEMENTS

[76] Inventor: Marek Zlotek, 100, rue Beranger, 92320 Chatillon, France

[21] Appl. No.: 136,294

[22] Filed: Dec. 22, 1987

[30] Foreign Application Priority Data

Dec. 24, 1986 [FR] France ..... 86 18157

[51] Int. Cl.[4] ..... A47F 7/00

[52] U.S. Cl. ..... 211/183

[58] Field of Search ..... 211/183, 186, 135, 43, 211/42, 73, 188; 248/915; 108/60, 61

[56] References Cited

U.S. PATENT DOCUMENTS

| | | | |
|---|---|---|---|
| 504,233 | 8/1893 | McVey et al. | 211/43 |
| 1,598,467 | 8/1926 | Weeks | 211/43 |
| 3,385,450 | 5/1968 | Nadler et al. | 211/42 |
| 4,100,912 | 7/1978 | Doane | 211/73 X |
| 4,637,632 | 1/1987 | Rubash et al. | 211/43 X |

FOREIGN PATENT DOCUMENTS

| | | | |
|---|---|---|---|
| 22741 | 6/1883 | Fed. Rep. of Germany | 211/43 |
| 2149 | of 1878 | United Kingdom | 211/42 |

*Primary Examiner*—Robert W. Gibson, Jr.
*Attorney, Agent, or Firm*—Bucknam and Archer

[57] ABSTRACT

The dressing element according to the invention is constituted by a substantially rectangular plate presenting two slots substantially parallel to the transverse sides and a line of fold joining the blind ends of these slots substantially parallel to the longitudinal side, this plate comprising, after being bent along said line, a U-surround which extends perpendicularly to the central panel adapted to rest on a shelf and of which the lateral arms constitute dummy uprights, while its web forms a flange covering the edge of this self.

5 Claims, 1 Drawing Sheet

ELEMENT FOR DRESSING SHELVES AND DISPLAY COMPOSED OF SUCH ELEMENTS

FIELD OF THE INVENTION

The present invention relates to an element for dressing a shelf and to a counter display composed of such elements.

BACKGROUND OF THE INVENTION

In certain stores, the products to be sold are stored and displayed on shelves so that the customers can help themselves and place all their purchases in a trolley or basket before paying at the pay-desk.

In this type of sale, the products to be promoted, on which the customer's attention must be drawn, are difficult to display well, since they are stored and displayed on the same shelves and under the same conditions as the other products.

Such shelves are generally mounted in overhang on brackets fixed, in dismountable manner, on a rear, vertical panel. Consequently, the front of the lines of display shelves is entirely open and the shelves are accessible from the front over the whole of their length.

It is an object of the present invention to design a decorative dressing element, adapted to be placed on the shelves and to be removed therefrom, easily and without the aid of a tool, in order to constitute by superposition and possibly by juxtaposition, an attractive display cabinet with multiple bays, of which the frames attract attention. Concomitantly, such an element must be easy to store away, taking up little space and its cost price must be moderate.

SUMMARY OF THE INVENTION

To this end, and according to the invention, the dressing element is constituted solely by a substantially rectangular metal plate presenting two slots substantially parallel to the transverse sides and a line of fold joining the blind ends of these slots substantially parallel to the longitudinal side, this plate comprising, after being bent along said line, a U-surround which extends perpendicularly to the central panel and of which the lateral arms constitute dummy uprights whilst its web forms a flange covering the edge of this shelf.

According to an important feature of the invention, the margins of the dummy uprights and of the flange are cut out to correspond to the aesthetic profile chosen for the display, this allowing a limitless evolution of the design accompanying the launching of each product, simply by varying the cut-out.

The invention also extends to any display cabinet comprising at least two superposed elements of which the dummy uprights are aligned and overlap at their ends and/or at least two juxtaposed elements of which the dummy uprights are contiguous and/or at least partially superposed.

U.S. Pat. No. 2,888,148 describes a shelf extension element for increasing the forward storage capacity of this shelf. The extension element is made of cardboard so that flanges folded on themselves and locked by tabs to be fitted in slots give this cardboard structure a rigidity such that it can support the products normally placed on the main shelf, which the cardboard plate without the flanges could not do. In addition, these flanges present notches for the extension element to be fittable on the main shelf and consequently not to risk tipping forwards and downwards under the weight of the load.

U.S. Pat. No. 1,951,415 describes a device for displaying goods. This device is likewise made of cardboard and is constituted by a rear part and a lower part joined together by means of tabs.

The rear part comprises a wall forming the back, two side walls and two front flanges.

The front part comprises a horizontal panel forming part, by reason of the bend of the cardboard, with a surround of very small height. It is important to note that the panel is not intended to rest on a shelf since it is the lower edges of the walls of the rear part and of the surround of the front part which rest on said shelf, the panel then being supported by its rear flange penetrating behind the tab and by the sides of the surround which are fixed to the front flanges of the rear part. In fact, this is a display cabinet in the form of a box and it seems difficult to remove the panel and its surround from this assembly, without taking into account the rest. Moreover, the uprights of the surround have a limited height, with the result that the surround cannot constitute the display cabinet by itself. It is its combination with the rear part which gives an attractive appearance to the whole.

It is therefore clear that these two documents do not teach anything likely to suggest the present invention as set forth hereinabove.

BRIEF DESCRIPTION OF THE DRAWINGS

The invention will be more readily understood on reading the following description with reference to the accompanying drawings, in which.

DETAILED DESCRIPTION OF THE DRAWINGS

Figure 1:
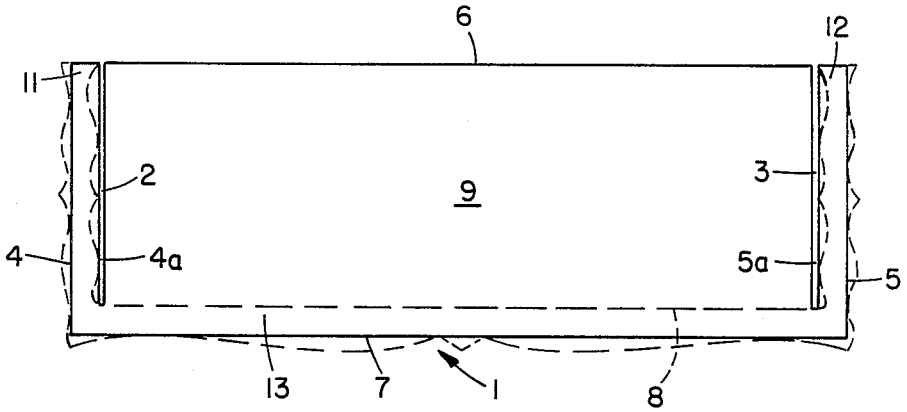
FIG. 1 is a plan view illustrating, before folding, in solid lines, an embodiment of a dressing element according to the invention, and, in broken lines, one of the possible variants.

Referring now to the drawings, FIG. 1 shows that each element 1 is constituted by a rectangular plate which, in the embodiment chosen, is made of enamelled metal. Two blind slots 2, 3 are cut out in the plate parallel to the transverse sides 4, 5 thereof. They open out on the rear longitudinal side 6 of said plate, whilst their blind ends are at a distance from the front longitudinal side 7 and joined by a line of fold 8 parallel to the latter.

The slots 2, 3 and line 8 define a U-surround which, by being folded along this line (FIG. 2), extends perpendicularly to the remaining part 9 of the plate forming panel and adapted to rest on a shelf 10 of the display cabinet shown in thin lines. The two side arms 11, 12 of this surround constitute dummy uprights, whilst the web 13 of said surround forms a flange provided to cover and conceal the edge of the shelf in question.

Figure 2:
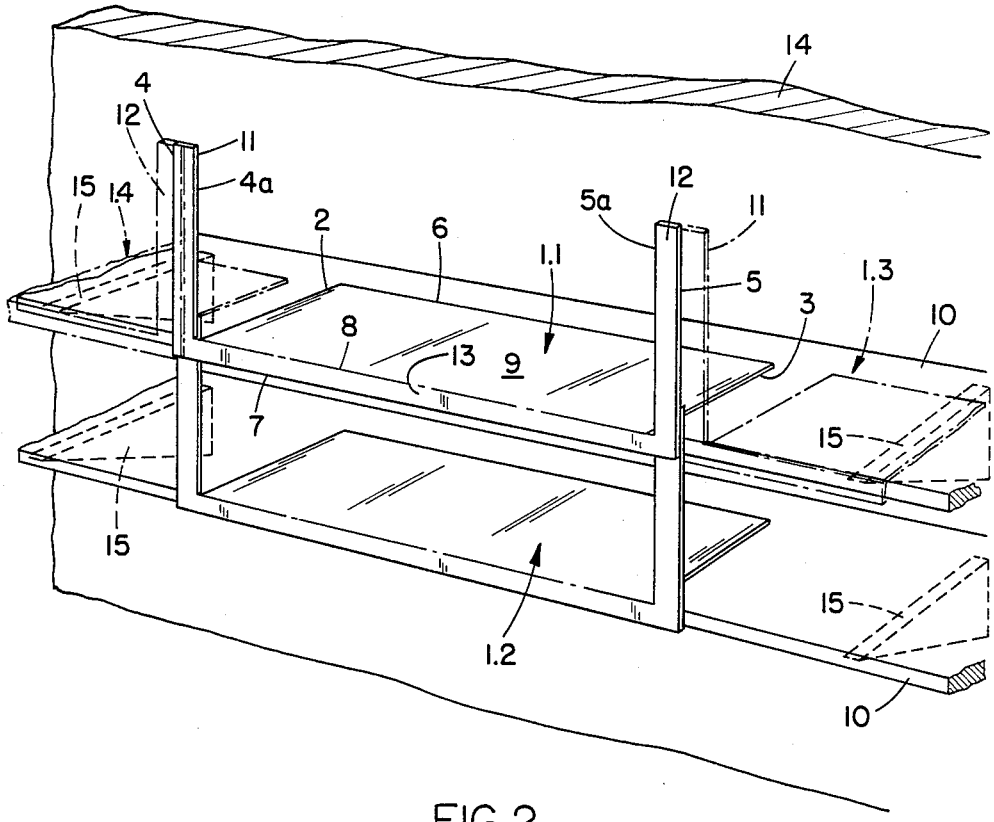
FIG. 2 is a view in perspective showing, in thick solid lines, a display means composed of two elements formed by folding and superposed, resting on the shelves of a display cabinet shown in fine solid lines, this perspective also showing in broken lines the extension of the display by juxtaposition of other identical elements on the same shelf, elements of which the dummy uprights are, to the left, superposed and, to the right, placed edge to edge.

In the embodiment shown in solid lines in FIGS. 1 and 2, the edges 4, 4*a*, 5, 5*a* of the dummy uprights 11, 12 are straight and parallel to each other; similarly, the lower edge 7 of the flange 13 is straight and parallel to the line of fold 8.

However, it is obvious that these edges may be shaped differently in order to change the aesthetic appearance. For example, these edges may be cut in sweeping curves, as represented in broken lines in FIG. 1.

The display cabinet mentioned hereinabove comprises shelves 10 placed in overhang so that their front is completely open and their contents accessible without any hindrance. Such a cabinet may comprise a vertical rear panel 14 forming art, in rigid and stable manner, with a foundation. Brackets 15 are mounted on the panel and support the shelves 10.

Dressing elements 1 such as described hereinabove are normally placed on these shelves in order to constitute a display with bays whose arrangement is essentially variable.

A first basic arrangement is illustrated in solid lines in FIG. 2. Two elements 1.1 and 1.2 are superposed so that the dummy uprights 11, 12 of the upper element 1.1 overlap the top end of the dummy uprights of the lower element 1.2 which are aligned with the preceding ones.

A second basic arrangement is illustrated on the right-hand side of FIG. 2 in solid lines and in broken lines. Two elements 1.1 and 1.3 are juxtaposed on the same shelf so that their dummy uprights 12, 11 respectively are placed edge to edge.

A third basic arrangement is illustrated on the left-hand side of FIG. 2 in solid lines and in broken lines. Two elements 1.1 and 1.4 are juxtaposed on the same shelf so that their dummy uprights 11, 12 respectively overlap partially (FIG. 2) or completely.

Of course, in these basic arrangements, the elements 1 may be more numerous and all these arrangements may be combined together to correspond to the appearance chosen for the display cabinet.

It is indicated in the foregoing that each element is made of bent metal. It is obvious that other materials and other shaping techniques may be employed. For example, the elements may be made of thermoformed plastics material, panels of glued plywood, or the like.

What is claimed is:

1. A dressing element for a shelf adapted to form a display which consists solely of a substantially rectangular metal plate, said plate having two slots substantially parallel to the transverse sides thereof, said slots having a blind end and opening out in the rear side of said plate, a fold line joining the blind end of said slots substantially parallel to the longitudinal side of said plate, said plate comprising, after being bent along said line, a U-surround which has a central panel, said surround extending perpendicularly to the said central panel of said element and adapted to rest on said shelf, said surround having lateral arms and a web, said lateral arms forming dummy uprights, said web forming a flange which covers the edge of said shelf.

2. The dressing element of claim 1, wherein said dummy uprights and said flange have margins, said margins are cut out to correspond to the aesthetic profile chosen for the display.

3. A display comprising at least two superposed elements according to claim 1 wherein the dummy uprights of said elements have an end, said ends are aligned and overlap at the ends thereof.

4. A display comprising at least two elements according to claim 1, juxtaposed on the same shelf, wherein the dummy uprights of said elements are contiguous.

5. A display comprising at least two elements according to claim 1, juxtaposed on the same shelf, wherein the dummy uprights of said elements are at least partially superposed on one another.

* * * * *